US009157044B2

(12) United States Patent
Oda

(10) Patent No.: US 9,157,044 B2
(45) Date of Patent: Oct. 13, 2015

(54) BEARING LUBRICANT COMPOSITION

(71) Applicants: BALBIS CO.,LTD., Hyogo (JP); Sato Special Oil Co., Ltd., Osaka (JP); KNC LABORATORIES CO., LTD., Hyogo (JP)

(72) Inventor: Akihiro Oda, Osaka (JP)

(73) Assignees: BALBIS CO., LTD., Hyogo (JP); SATO SPECIAL OIL CO., LTD., Osaka (JP); KNC LABORATORIES CO., LTD., Kobe-Shi, Hyogo (JP)

( * ) Notice: Subject to any disclaimer, the term of this patent is extended or adjusted under 35 U.S.C. 154(b) by 300 days.

(21) Appl. No.: 13/631,096

(22) Filed: Sep. 28, 2012

(65) Prior Publication Data

US 2013/0096042 A1 Apr. 18, 2013

(30) Foreign Application Priority Data

Sep. 30, 2011 (JP) ..... 2011-217511
Sep. 20, 2012 (JP) ..... 2012-207168

(51) Int. Cl.

| | |
|---|---|
| ***C10M 105/34*** | (2006.01) |
| ***C10M 105/38*** | (2006.01) |
| ***C10M 129/70*** | (2006.01) |
| ***C10M 129/74*** | (2006.01) |
| ***C10M 105/36*** | (2006.01) |

(52) U.S. Cl.

CPC ..... *C10M 105/36* (2013.01); *C10M 105/38* (2013.01); *C10M 2207/2835* (2013.01); *C10N 2230/02* (2013.01); *C10N 2230/06* (2013.01); *C10N 2230/74* (2013.01); *C10N 2240/02* (2013.01)

(58) Field of Classification Search

CPC ..... C10M 105/34; C10M 105/38; C10M 129/70; C10M 129/74; C10M 2207/2805; C10M 2207/2835

USPC ..... 508/496, 497, 498, 499; 560/187, 189

See application file for complete search history.

(56) References Cited

U.S. PATENT DOCUMENTS

| | | | | |
|---|---|---|---|---|
| 4,968,453 | A * | 11/1990 | Wada et al. | 508/492 |
| 5,780,400 | A * | 7/1998 | MacNeil et al. | 508/496 |
| 5,797,700 | A * | 8/1998 | Varadaraj et al. | 405/60 |
| 5,939,366 | A * | 8/1999 | MacNeil et al. | 508/496 |
| 6,903,056 | B2 * | 6/2005 | Nagano et al. | 508/496 |
| 7,517,838 | B2 * | 4/2009 | Kawahara et al. | 508/485 |
| 8,153,569 | B2 * | 4/2012 | Kuratomi et al. | 508/496 |
| 8,343,899 | B2 * | 1/2013 | Ichisaka et al. | 508/463 |
| 8,722,602 | B2 * | 5/2014 | Fujinami et al. | 508/528 |
| 2004/0176261 | A1 * | 9/2004 | Tojou et al. | 508/485 |
| 2009/0318316 | A1 * | 12/2009 | Morishima | 508/100 |
| 2009/0318317 | A1 * | 12/2009 | Morishima | 508/100 |
| 2011/0109995 | A1 * | 5/2011 | Kodama et al. | 360/234.1 |
| 2013/0029893 | A1 * | 1/2013 | Okazaki et al. | 508/496 |

FOREIGN PATENT DOCUMENTS

| | | |
|---|---|---|
| JP | 2008-007741 | 1/2008 |
| WO | WO 2004-018595 | 3/2004 |

* cited by examiner

*Primary Examiner* — Ellen McAvoy

(74) *Attorney, Agent, or Firm* — Muncy, Geissler, Olds & Lowe, P.C.

(57) ABSTRACT

A bearing lubricant composition includes a base oil containing an ester compound (α) represent by the general formula (1), and has a pour point of −30° C. or lower and a viscosity index of 150 or more.

(1)

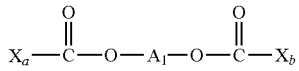

[wherein, $A_1$ is a $C_{3-8}$ linear or branched alkylene group; and at least one of $X_a$ and $X_b$ is a $C_{2-20}$ linear or branched alkyl ether group, or when it is not an alkyl ether group, it is a $C_{5-13}$ linear or branched alkyl group.]

16 Claims, No Drawings

BEARING LUBRICANT COMPOSITION

BACKGROUND OF THE INVENTION

1. Field of the Invention

The present invention relates to a bearing lubricant composition.

2. Description of the Related Art

The miniaturization and low power consumption of the electronic apparatuses, such as home electrical appliances, electronic and information products, industrial machines, and mobile terminals, progress every year. The usable temperature ranges of these electronic apparatuses also expand every year. With these trends, spindle motors in which fluid bearings (fluid dynamic bearings), etc., are mounted, have been used in disk drive devices to be used in these electronic apparatuses.

The miniaturization and low power consumption of these electronic apparatuses, and the expansion of the usable temperature ranges thereof are achieved mostly by improvements in the performances of motors. One of the means for achieving an improvement in the performance of a motor or a device in which the motor is mounted is to enhance the performance of a bearing, such as a fluid bearing, which is mounted in the motor. Accordingly, in order to achieve an improvement in the performance of a bearing, various bearing lubricant compositions have been presented (see, for example, Patent Documents 1 and 2).

[Patent Document 1] International Patent Application Pamphlet No. 2004/018595

[Patent Document 2] Japanese Patent Application Publication No. 2008-7741

In recent years, there is an increasing demand for expanding the usable temperature ranges of these electronic apparatuses. In particular, there is a need for expanding the applications of these electronic apparatuses to mobile apparatuses, and hence motors and devices in which the motors are mounted are required to withstand the use under severer temperature environments. That is, there is a strong demand that the usable temperature ranges of motors and devices in which the motors are mounted should be expanded and they should be stably driven when temperature changes. Accordingly, bearing lubricant compositions are also required to have expanded usable temperature ranges and have small changes in viscosity with temperature.

SUMMARY OF THE INVENTION

The present invention has been made in view of such a problem, and a purpose of the invention is to provide a bearing lubricant composition that has a wide usable temperature range and a small change in viscosity with temperature.

An embodiment of the present invention is a bearing lubricant composition. This bearing lubricant composition includes a base oil containing an ester compound (α) represented by the general formula (1), and has a pour point of −30° C. or lower and a viscosity index of 150 or more.

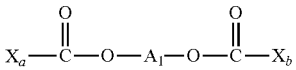

(1)

[wherein, $A_1$ is a $C_{3-8}$ linear or branched alkylene group; and at least one of $X_a$ and $X_b$ is a $C_{2-20}$ linear or branched alkyl ether group, or when it is not an alkyl ether group, it is a $C_{5-13}$ linear or branched alkyl group that may have an unsaturated bond.]

According to the embodiment, a bearing lubricant composition that has a wide usable temperature range and a small change in viscosity with temperature.

DETAILED DESCRIPTION OF THE INVENTION

The invention will now be described by reference to the preferred embodiments. This does not intend to limit the scope of the present invention, but to exemplify the invention.

The present invention will now be described based on preferred embodiments. The preferred embodiments do not limit the scope of the invention but exemplify the invention. All of the features and the combinations thereof described in the embodiments are not necessarily essential to the invention. It can be readily understood by a person skilled in the art that various variations may be made to the combinations of respective components, which are also encompassed by the scope of the invention.

The bearing lubricant composition according to the present embodiment is a lubricating oil for bearings, which can be particularly and suitably used in fluid bearings. The bearing lubricant composition includes a base oil containing an ester compound (α) represented by the general formula (1).

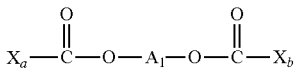

(1)

[wherein, $A_1$ is a $C_{3-8}$ linear or branched alkylene group; and at least one of $X_a$ and $X_b$ is a $C_{2-20}$ linear or branched alkyl ether group, or when it is not an alkyl ether group, it is a $C_{5-13}$ linear or branched alkyl group that may have an unsaturated bond.]

That is, the base oil in the bearing lubricant composition according to the present embodiment contains, as a major component, a diol ester composed of diol (HO-$A_1$-OH), a first carboxylic acid ($X_a$—COOH) and a second carboxylic acid ($X_b$—COOH) The diol ester is an ether-containing diol ester in which at least one of the first carboxylic acid and the second carboxylic acid contains an oxygen atom in the main carbon chain, i.e., includes an ether bond.

Examples of the ester compound (α) represented by the aforementioned general formula (1) include an ester compound (α1) represented by the general formula (2).

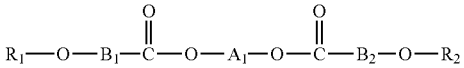

(2)

[wherein, $A_1$ is a $C_{3-8}$ linear or branched alkylene group; $B_1$ and $B_2$ may or may not be the same as each other, and each of them is a $C_{1-10}$ linear or branched alkylene group; and $R_1$ and $R_2$ may or may not be the same as each other, and each of them is a $C_{1-10}$ linear or branched alkyl group.]

The ester compound (α1) corresponds to a compound in which, in the general formula (1), each of $X_a$ and $X_b$ is an alkyl ether group that includes an ether bond. That is, the ester compound (α1) is an ether-containing diol ester composed of diol (HO-$A_1$-OH), a first carboxylic acid ($R_1$—O—$B_1$—COOH), and a second carboxylic acid ($R_2$—O—$B_2$—

COOH), in which: the first carboxylic acid is produced with an alkylene group $B_1$ and an alkyl group $R_1$ being bonded together via an ether bond and with a carboxyl group (—COOH) being bonded to the alkylene group $B_1$; and the second carboxylic acid is produced with an alkylene group $B_2$ and an alkyl group $R_2$ being bonded together via an ether bond and with a carboxyl group (—COOH) being bonded to the alkylene group $B_2$.

Examples of the ester compound (α) represented by the aforementioned general formula (1) include an ester compound (α2) represented by the general formula (3).

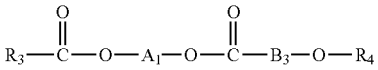

(3)

[wherein, $A_1$ is a $C_{3-8}$ linear or branched alkylene group; $B_3$ is a $C_{1-10}$ linear or branched alkylene group; $R_3$ is a $C_{5-13}$ linear or branched alkyl group that may have an unsaturated bond; and $R_4$ is a $C_{1-10}$ linear or branched alkyl group.]

The ester compound (α2) corresponds to a compound in which, in the general formula (1), $X_b$ is an alkyl ether group that includes an ether bond and $X_a$ is an alkyl group that does not include an ether bond. That is, the ester compound (α2) is an ether-containing diol ester composed of diol (HO-$A_1$-OH), a first carboxylic acid ($R_3$—COOH), and a second carboxylic acid ($R_4$—O—$B_3$—COOH), in which: the first carboxylic acid is produced with a carboxylic group (—COOH) being bonded to an alkyl group $R_3$; and the second carboxylic acid is produced with an alkylene group $B_3$ and an alkyl group $R_4$ being bonded together via an ether bond and with a carboxylic acid (—COOH) being bonded to the alkylene group $B_3$.

The alkylene group $A_1$ in the diol (HO-$A_1$-OH) is a $C_{3-8}$ linear or branched alkylene group. By making the number of the carbons in the alkylene group $A_1$ to be 3 or more, evaporation of the diol can be prevented; and making the number thereof to be 8 or less, an increase in the viscosity of a bearing lubricant composition and an increase in the pour point thereof can be suppressed. Examples of the diol (HO-$A_1$-OH) include, for example: 1,3-propanediol, 1,4-butanediol, 2-methyl-1,3-propanediol, 1,5-pentanediol, 2-methyl-1,4-butanediol, 2-ethyl-1,3-propanediol, neopentyl glycol, 1,6-hexandiol, 2-methyl-1,5-pentanediol, 3-methyl-1,5-pentanediol, 2-ethyl-2-methyl-1,3-propanediol, 2-propyl-1,3-propanediol, etc. Among them, 3-methyl-1,5-pentanediol, neopentyl glycol, and 2-ethyl-2-methyl-1,3-propanediol are preferred, and 3-methyl-1,5-pentanediol is more preferred.

Each of the alkylene groups $B_1$ and $B_2$ in the ester compound (α1) and the alkylene group $B_3$ in the ester compound (α2) is a $C_{1-10}$ linear or branched alkylene group, and is preferably a $C_{3-5}$ linear or branched alkylene group. By making the number of the carbons in each of the alkylene groups $B_1$, $B_2$, and $B_3$ to be 10 or less, an increase in the viscosity of a bearing lubricant composition and an increase in the pour point thereof can be suppressed. Preferred examples of the alkylene groups $B_1$, $B_2$, and $B_3$ include, an ethylene group, n-propylene group, n-butylene group, n-pentylene group, n-hexylene group, n-heptylene group, and n-octylene group, etc. Among them, an n-propylene group, n-butylene group, and n-pentylene group can be exemplified as more preferred examples, and an n-pentylene group can be exemplified as a still more preferred example.

Each of the alkyl groups $R_1$ and $R_2$ in the ester compound (α1) and the alkyl group $R_4$ in the ester compound (α2) is a $C_{1-10}$ linear or branched alkyl group, and is preferably a $C_{1-5}$ linear or branched alkyl group. By making the number of the carbons in each of the alkyl groups $R_1$, $R_2$, and $R_4$ to be 10 or less, an increase in the pour point of a bearing lubricant composition, which is caused by an increase in the viscosity thereof, can be suppressed. Preferred examples of the alkyl groups $R_1$, $R_2$, and $R_4$ include a methyl group, ethyl group, n-propyl group, n-butyl group, and n-pentyl group, etc.

The alkyl group $R_3$ in the ester compound (α2) is a $C_{5-13}$ linear or branched alkyl group that may have an unsaturated bond. Preferred examples of the alkyl group $R_3$ include an n-octyl group, n-nonyl group, n-decyl group, n-undecyl group, and n-dodecyl group, etc.

In the ester compound (α) and ester compound (α1), the first carboxylic acid and the second carboxylic acid may or may not be the same as each other. In addition, the ester compound (α) may be used alone or in combination of two or more thereof. That is, the base oil may contain the ester compound (α1) alone, the ester compound (α2) alone, or both of them. When a combination of the ester compound (α1) and the ester compound (α2) is used, the diols in both the compounds may or may not be the same as each other. Also, the carboxylic acids in the ester compound (α1) and the ester compound (α2), each of the carboxylic acids including an ether bond, may or may not be the same as each other. As an ester compound (α) represented by the aforementioned general formula (1), the ester compound (α1) is preferable from the viewpoint of easy acquisition of the later-described effect of improving a temperature property.

In general, when the pour point of a bearing lubricant composition is reduced by making the molecular weight of a base oil to be small, the viscosity index of the bearing lubricant composition is decreased. Conversely, when the viscosity index is increased, the pour point is increased. On the other hand, in the bearing lubricant composition according to the present embodiment, the diol ester that forms the base oil has been made to be a diol ester that includes an ether bond. That is, the diol ester has been formed by binding, via an ester bond, a carboxylic acid whose carbon in the main chain has been replaced by oxygen to the hydroxyl group (—OH) in at least one of the diols. By using, in the base oil, a diol ester that includes an ether bond, as stated above, a pour point can be reduced while a viscosity index is being maintained. This is considered as follows: formation of a bond between the diol esters may be inhibited by an interaction between the oxygen atoms in the ether bond; and as a result, the pour point of the bearing lubricant composition may be reduced.

In the bearing lubricant composition according to the present embodiment, the pour point is −30° C. or lower and the viscosity index is 150 or more. Accordingly, the bearing lubricant composition according to the embodiment has a wider usable temperature range and a smaller change in viscosity with temperature than those of a conventional bearing lubricant composition including a base oil composed only of an ester compound that does not include an ether bond. The pour point is preferably −40° C. or lower, and more preferably −50° C. or lower.

In a bearing lubricant composition, the kinematic viscosity at 40° C. is preferably within a range of 7 to 20 $mm^2/s$, and more preferably within a range of 8 to 13 $mm^2/s$. By making, in a bearing lubricant composition, the kinematic viscosity at 40° C. to be within a range of 7 to 20 $mm^2/s$, the bearing lubricant composition can be used in bearings, such as fluid bearings. For example, by making a bearing lubricant composition have a low viscosity, the power consumption of the motor in which the bearing is mounted can be reduced and the operating time of the electronic apparatus in which this motor is mounted can be lengthened.

The base oil in the bearing lubricant composition according to the present embodiment may further contain an ester compound (β) represented by the general formula (4).

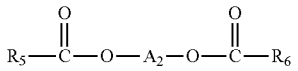

(4)

[wherein, $A_2$ is a $C_{3-8}$ linear or branched alkylene group; and $R_5$ and $R_6$ may or may not be the same as each other, each of which is a $C_{5-13}$ linear or branched alkyl group that may have an unsaturated bond.]

The ester compound (β) is a diol ester in which diol (HO-$A_2$-OH) and each of a third carboxylic acid ($R_5$—COOH) and a fourth carboxylic acid ($R_6$—COOH) are bonded together via an ester bond, each of the third carboxylic acid and the fourth carboxylic acid not including an oxygen atom in the main chain, i.e., not including an ether bond. The alkylene group $A_2$ is the same as the aforementioned alkylene group $A_1$. Also, the alkyl groups $R_5$ and $R_6$ are the same as the aforementioned alkyl group $R_3$. The alkylene groups $A_1$ and $A_2$ may or may not be the same as each other, and the alkyl groups $R_3$, $R_5$, and $R_6$ may or may not be the same as each other.

By containing, in the ester compound (β) not including an ether bond, at least one of the ester compound (α1) and the ester compound (α2) each including an ether bond, a reduction in the pour point and an increase in the viscosity index can be achieved.

The content of the base oil is, for example, within a range of 90 to 99% by mass, and preferably within a range of 95 to 99% by mass, based on the total mass of the bearing lubricant composition. The content of the ester compound (α) is, for example, within a range of 5 to 100% by mass, based on the total mass of the base oil. By making the content of the ester compound (α), based on the total mass of the base oil, to be 5% by mass or more, the effect of improving the temperature property of the bearing lubricant composition can be acquired more surely. When the ester compound (α1) and the ester compound (β) are mixed together, it is preferable to make, at the mixing, the mass ratio of the ester compound (α1) to the ester compound (β) to be within a range of (α1):(β)=100:0 to 5:95. Further, when the ester compounds (α1), (α2), and (β) are mixed together, it is preferable to make, at the mixing, the mass ratio of the respective ester compounds to be (α1):{(α2)+(β)}=100:0 to 5:95.

In the base oil in which the ester compound (α1) and the ester compound (β) have been mixed together, the carboxylate moiety of the ester compound (α1) and that of the ester compound (β) may be exchanged together by an ester exchange reaction, thereby possibly producing the ester compound (α2). In this case, the obtained ester compound (α2) includes an ester compound whose alkylene group is $A_1$ and that whose alkylene group is $A_2$ each originating from a diol. For example, when the ester compound (α1) and the ester compound (β) are mixed together at a ratio of 1:1, the final mass ratio of the ester compounds (α1), (α2), and (β) becomes, for example, (α1):(α2):(β)=1:1:1 or (α1):(α2):(β)=3:4:3.

The base oil may further contain one or more types of other compounds (γ) selected from the group consisting of the following (a) to (e). The content of the other compounds (γ) can be made to be within a range of 0 to 95% by mass, based on the total mass of the base oil. The mass ratio of the ester compound (α) to the other compounds (γ) may be, for example, within a ratio of 5:95 to 100:0.

(a) Diesters of One or More Types of Dicarboxylic Acids Selected from the Group Consisting of Adipic Acid, Pimelic Acid, Suberic Acid, Azelaic Acid, and Sebacic Acid, with a $C_{6-12}$ Alcohol Preferred examples of such diesters include di(2-ethylhexyl) adipate, di(3,5,5-trimethylhexyl) adipate, diisododecyl adipate, di(2-ethylhexyl) suberate, di(2-ethylhexyl)azelate, and di(2-ethylhexyl)sebacate, etc.

(b) Monoesters of a $C_{8-20}$ Saturated or Unsaturated Carboxylic Acid with a $C_{6-20}$ Alcohol Preferred examples of such monoesters include stearyl 2-ethylhexanoate, palmityl 2-ethylhexanoate, 2-ethylhexyl stearate, 2-ethylhexyl palmitate, 2-ethylhexyl myristate, and 2-ethylhexyl oleate, etc.

(c) Triesters of a $C_{3-10}$ Saturated or Unsaturated Carboxylic Acid with a Trimethylolpropane Preferred examples of such triesters include triesters of one or more types selected from the group consisting of n-pentanoate (n-pentyl), n-hexanoate (n-hexyl), n-heptanoate (n-heptyl), n-octanoate (n-octyl), n-nonanoate (n-nonyl), and n-decanoate (n-decyl), with trimethylolpropane, etc.

(d) Tetraesters of a $C_{3-10}$ Saturated or Unsaturated Carboxylic Acid with Pentaerythritol Preferred examples of such tetraesters include tetraesters of one or more types selected from the group consisting of n-pentanoate (n-pentyl), n-hexanoate (n-hexyl), n-heptanoate (n-heptyl), n-octanoate (n-octyl), n-nonanoate (n-nonyl), and n-decanoate (n-decyl), with pentaerythritol, etc.

(e) Mineral Oils or Synthetic Hydrocarbon Oils

As such mineral oils or synthetic hydrocarbon oils, conventional oils publicly known as mineral oils or synthetic hydrocarbon oils can be used.

The bearing lubricant composition may further contain at least one of a hindered phenolic antioxidant or a hindered amine antioxidant. By containing an antioxidant including at least one of the two antioxidants, oxidation of the bearing lubricant composition can be prevented and a long life of the bearing lubricant composition can be achieved. The content of these antioxidants is preferably 0.1% by mass or more and 10.0% by mass or less, based on the total mass of the bearing lubricant composition.

Examples of the hindered phenolic antioxidant include, for example: mono-phenol antioxidants, such as 2,6-di-tert-butyl-4-hydroxytoluene and n-octadecyl-3-(3',5'-di-tert-butyl-4'-hydroxyphenyl)propionate; di-phenol antioxidants, such as 4,4'-butylidenebis(3-methyl-6-tert-butylphenol) and 4,4'-methylenebis(4-methyl-6-tert-butylphenol); and phenolic antioxidants including three or more 2,6-di-tert-butyl-4-hydroxy structures. These phenolic antioxidants may be used alone or in combination of two or more thereof.

Examples of the hindered amine antioxidant include, for example: dialkylated diphenylamine, dioctyldiphenylamine, and 4,4'-bis(α,α-dimethylbenzyl)diphenylamine, etc. These amine antioxidants may be used alone or in combination of two or more thereof.

As described above, the bearing lubricant composition according to the present embodiment includes a base oil containing a diol ester that includes an ether bond, the diol ester being represented by the aforementioned general formula (1), and has a pour point of −30° C. or lower and a viscosity index of 150 or more. Accordingly, a bearing lubricant composition having a wide usable temperature range and a small change in viscosity with temperature can be obtained. That is, a low pour point and a high viscosity index can be both achieved. Further, because it is prevented that the molecular weight of the base oil may be reduced for the purpose of reducing the pour point, an increase in the evaporation loss of the bearing lubricant composition can be suppressed. Accordingly, when the bearing lubricant composition according to the embodiment is used in a bearing, such as a fluid bearing, the resistance between a rotating body and the bearing can be maintained to be small for a long period of time or under a low-temperature environment.

EXAMPLES

Hereinafter, examples of the present invention will be described, which do not intend to limit the scope of the invention, but are presented as preferred illustrative examples of the invention.

Bearing lubricant compositions according to Examples 1 to 5 and Comparative Examples 1 to 5 were prepared. The bearing lubricant compositions can be prepared by a conventionally and publicly-known method. The composition of each bearing lubricant composition is shown in following Table 1. In addition, the following additives were added: assuming that the total mass of the bearing lubricant composition according to each of Examples and Comparative Examples was 100% by mass, 0.5% by mass of an antioxidant, 0.5% by mass of an extreme pressure agent, and 0.1% by mass of a metal deactivator. The balance obtained by deducting the total % by mass of the additives from 100% by mass of the bearing lubricant composition was made to the content of the bear Oil.

TABLE 1

| | | EXAMPLE 1 | EXAMPLE 2 | EXAMPLE 3 | EXAMPLE 4 | EXAMPLE 5 | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|---|---|---|---|---|---|
| BASE OIL | COM-POUND | ESTER COMPOUND (α1) | ESTER COMPOUND (αl) | ESTER COMPOUND (αl) | ESTER COMPOUND (α1) ESTER COMPOUND (β) | ESTER COMPOUND (α1) | ESTER COMPOUND (β) | ESTER COMPOUND (β) | NONANOIC ACID ESTER | DOS | MONOESTER |
| | $A_1$, $A_2$ | 3-METHYL-1,5-PENTANEDIOL | | | | | | | — | — | — |
| | $B_1$ | n-PENTYLENE GROUP | | | | | — | — | — | — | — |
| | $B_2$ | n-PENTYLENE GROUP | | | | METHYLENE GROUP | — | — | — | — | — |
| | $R_1$ | ETHYL GROUP | n-PROPYL GROUP | n-BUTYL GROUP | ETHYL GROUP | ETHYL GROUP | — | — | — | — | — |
| | $R_2$ | ETHYL GROUP | n-PROPYL GROUP | n-BUTYL GROUP | ETHYL GROUP | n-HEXYL GROUP | — | — | — | — | — |
| | $R_5$, $R_6$ | — | — | — | n-OCTYL GROUP | — | n-OCTYL GROUP | n-NONYL GROUP | — | — | — |
| 0° C. KINEMATIC VISCOSITY ($mm^2/s$) | | 43.6 | 53.2 | 60.3 | 42.6 | 52.6 | 40.4 | 50.6 | 50.4 | 69.8 | 50.6 |
| 40° C. KINEMATIC VISCOSITY ($mm^2/s$) | | 9.61 | 11.41 | 12.55 | 9.44 | 10.80 | 9.2 | 11.06 | 9.06 | 11.89 | 9.35 |
| 100° C. KINEMATIC VISCOSITY ($mm^2/s$) | | 2.84 | 3.27 | 3.6 | 2.81 | 3.18 | 2.76 | 3.2 | 2.57 | 3.24 | 2.75 |
| VISCOSITY INDEX | | 153 | 169 | 188 | 154 | 174 | 153 | 169 | 115 | 148 | 144 |
| 120 HOURS EVAPORATION AMOUNT (wt %) | | 1.85 | 0.88 | 0.51 | 2.04 | 1.08 | 2.22 | 1.1 | 10.46 | 1.06 | 7.9 |
| 500 HOURS EVAPORATION AMOUNT (wt %) | | 6.91 | 4.44 | 2.81 | 7.81 | 5.64 | 8.24 | 6.5 | 37.29 | 4.79 | 30.41 |
| FRICTION COEFFICIENT | | 0.11 | 0.11 | 0.1 | 0.11 | 0.11 | 0.13 | 0.12 | 0.14 | 0.12 | 0.15 |
| POUR POINT (° C.) | | −50 OR LOWER | −50 OR LOWER | −50 OR LOWER | −50 OR LOWER | −50 OR LOWER | −27.5 | −17.5 | −27.5 | −50 OR LOWER | −45 |

In Example 4, the base oil was prepared by mixing the ester compound (α1) and the ester compound (β) together at a mass ratio of 1:1. Nonanoic acid ester, the base oil in Comparative Example 3, is neopentyl glycol di-n-nonanoic acid ester. DOS, the base oil in Comparative Example 4, is di(2-ethylhexyl) sebacate. The monoester, the base oil in Comparative Example 5, is 2-ethylhexyl methyl heptadecylate.

(Viscosity Measurement, Viscosity Index Calculation)

The kinematic viscosity ($mm^2/s$) of the bearing lubricant composition of each of Examples and Comparative Examples was measured at 0° C., 40° C., and 100° C. The kinematic viscosity was measured by using a Cannon-Fenske viscometer according to JIS K 2283. Also, a viscosity index was calculated from the kinematic viscosities at 40° C. and 100° C. according to JIS K 2283. The results are shown in Table 1.

(Evaporation Amount Measurement)

The evaporation amount (% by mass) of the bearing lubricant composition of each of Examples and Comparative Examples was measured at a lapse of each of 120 hours and 500 hours. A reduction amount of each bearing lubricant composition, the reduction occurring when 120 hours or 150 hours have passed since the bearing lubricant composition was left uncontrolled at 120° C. after being placed into a SUS 304 container, was made to be the evaporation amount. The results are shown in Table 1.

(Friction Coefficient Measurement)

The friction coefficient of the bearing lubricant composition of each of Examples and Comparative Examples was measured by a Soda pendulum test machine. In this test, each bearing lubricant composition is provided to the friction portion in the supporting point of a pendulum and the pendulum is vibrated, thereafter calculating a friction coefficient from a vibration attenuation. This friction coefficient measurement was performed at room temperature. The results are shown in Table 1.

(Pour Point Measurement)

The pour point of the bearing lubricant composition of each of Examples and Comparative Examples was measured according to JIS K 2269. The results are shown in Table 1.

As shown in Table 1, in the bearing lubricant composition of each of Examples 1 to 5, the pour point was −30° C. or lower and the viscosity index was 150 or more. On the other hand, in each of Comparative Examples 1 and 2, the viscosity index was 150 or more, but the pour point was higher than −30° C. In Comparative Example 3, the pour point was higher than −30° C. and the viscosity index was less than 150. In each of Comparative Examples 4 and 5, the pour point was −30° C. or lower, but the viscosity index was less than 150. It is shown from these results that, in the bearing lubricant composition of each of Examples 1 to 5, good pour point and good viscosity index can be both achieved.

From the result of the bearing lubricant composition of Example 4, the composition including a base oil in which the ester compound (α1), the same as that in Example 1, and the ester compound (β), the same as that in Comparative Example 1, have been mixed together, it is shown that, by mixing the ester compound (α1) into the ester compound (β) that is a conventional base oil, the pour point of the bearing lubricant composition of Comparative Example 1, which has been a problem in the composition, can be improved and a good viscosity index can be maintained.

The kinematic viscosity in each of Examples 1 to 5 was within a range of 7 to 20 $mm^2/s$ at 40° C. Further, the bearing lubricant composition in each of Examples 1 to 5 had a low evaporation amount, and accordingly had a good lubricating property. Accordingly, the bearing lubricant composition according to the present embodiment is excellent in the flow performance at low temperature, is stable with temperature, and is provided with performances required of a bearing to be mounted in a small motor, etc., such as low viscosity, heat resistance, and lubricating property.

What is claimed is:

1. A bearing lubricant composition comprising a base oil containing an ester compound (α) represented by the general formula (1), wherein a pour point is −30° C. or lower and a viscosity index is 150 or more,

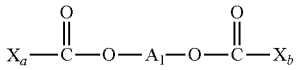

(1)

wherein $A_1$ is a $C_{3-8}$ linear or branched alkylene group; and one of $X_a$ and $X_b$ is a $C_{2-20}$ linear or branched alkyl ether group and one of $X_a$ and $X_b$ is a $C_{5-13}$ linear or branched alkyl group, or $X_a$ a d $X_b$ are both a $C_{2-20}$ linear or branched alkyl ether group.

2. The bearing lubricant composition according to claim 1, wherein the ester compound (α) contains an ester compound (α1) represented by the formula (2),

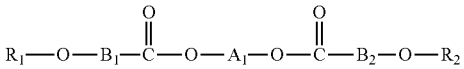

(2)

wherein $A_1$ is a $C_{3-8}$ linear or branched alkylene group; $B_1$ and $B_2$ may or may not be the same as each other, and each of them is a $C_{1-10}$ linear or branched alkylene group; and $R_1$ and $R_2$ may or may not be the same as each other, and each of them is a $C_{1-10}$ linear or branched alkyl group.

3. The bearing lubricant composition according to claim 1, wherein the base oil further contains an ester compound (β) represented by the general formula (4),

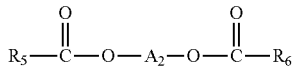

(4)

wherein $A_2$ is a $C_{3-8}$ linear or branched alkylene group; and $R_5$ and $R_6$ may or may not be the same as each other, and each of them is a $C_{5-13}$ linear or branched alkyl group that may have an unsaturated bond.

4. The bearing lubricant composition according to claim 1, wherein the base oil further contains one or more types of other compounds (γ) selected from the group consisting of the following (a) to (e): (a) diesters of one or more types of dicarboxylic acids selected from the group consisting of adipic acid, pimelic acid, suberic acid, azelaic acid, and sebacic acid, with a $C_{6-12}$ alcohol; (b) monoesters of a $C_{8-20}$ saturated or unsaturated carboxylic acid with a $C_{6-20}$ alcohol; (c) triesters of a $C_{3-10}$ saturated or unsaturated carboxylic acid with a trimethylolpropane; (d) tetraesters of a $C_{3-10}$ saturated or unsaturated carboxylic acid with pentaerythritol; and (e) mineral oils or synthetic hydrocarbon oils.

5. The bearing lubricant composition according to claim 1, wherein the kinematic viscosity at 40° C. is within a range of 7 to 20 $mm^2/s$.

6. The bearing lubricant composition according to claim 2, wherein the base oil further contains an ester compound (β) represented by the general formula (4),

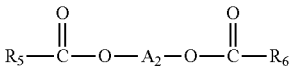

(4)

wherein $A_2$ is a $C_{3-8}$ linear or branched alkylene group; and $R_5$ and $R_6$ may or may not be the same as each other, and each of them is a $C_{5-13}$ linear or branched alkyl group that may have an unsaturated bond.

7. The bearing lubricant composition according to claim 2, wherein the base oil further contains one or more types of other compounds (γ) selected from the group consisting of the following (a) to (e): (a) diesters of one or more types of dicarboxylic acids selected from the group consisting of adipic acid, pimelic acid, suberic acid, azelaic acid, and sebacic acid, with a $C_{6-12}$ alcohol; (b) monoesters of a $C_{8-20}$ saturated or unsaturated carboxylic acid with a $C_{6-20}$ alcohol; (c) triesters of a $C_{3-10}$ saturated or unsaturated carboxylic acid with a trimethylolpropane; (d) tetraesters of a $C_{3-10}$ saturated or unsaturated carboxylic acid with pentaerythritol; and (e) mineral oils or synthetic hydrocarbon oils.

8. The bearing lubricant composition according to claim 3, wherein the base oil further contains one or more types of other compounds (γ) selected from the group consisting of the following (a) to (e): (a) diesters of one or more types of dicarboxylic acids selected from the group consisting of adipic acid, pimelic acid, suberic acid, azelaic acid, and sebacic acid, with a $C_{6-12}$ alcohol; (b) monoesters of a $C_{8-20}$ saturated or unsaturated carboxylic acid with a $C_{6-20}$ alcohol; (c) triesters of a $C_{3-10}$ saturated or unsaturated carboxylic acid with a trimethylolpropane; (d) tetraesters of a $C_{3-10}$ saturated or unsaturated carboxylic acid with pentaerythritol; and (e) mineral oils or synthetic hydrocarbon oils.

9. The bearing lubricant composition according to claim 6, wherein the base oil further contains one or more types of other compounds (γ) selected from the group consisting of the following (a) to (e): (a) diesters of one or more types of dicarboxylic acids selected from the group consisting of adipic acid, pimelic acid, suberic acid, azelaic acid, and sebacic acid, with a $C_{6-12}$ alcohol; (b) monoesters of a $C_{8-20}$ saturated or unsaturated carboxylic acid with a $C_{6-20}$ alcohol; (c) triesters of a $C_{3-10}$ saturated or unsaturated carboxylic acid with a trimethylolpropane; (d) tetraesters of a $C_{3-10}$ saturated or unsaturated carboxylic acid with pentaerythritol; and (e) mineral oils or synthetic hydrocarbon oils.

10. The bearing lubricant composition according to claim 2, wherein the kinematic viscosity at 40° C. is within a range of 7 to 20 $mm^2/s$.

11. The bearing lubricant composition according to claim 3, wherein the kinematic viscosity at 40° C. is within a range of 7 to 20 $mm^2/s$.

12. The bearing lubricant composition according to claim 4, wherein the kinematic viscosity at 40° C. is within a range of 7 to 20 $mm^2/s$.

13. The bearing lubricant composition according to claim 6, wherein the kinematic viscosity at 40° C. is within a range of 7 to 20 $mm^2/s$.

14. The bearing lubricant composition according to claim 7, wherein the kinematic viscosity at 40° C. is within a range of 7 to 20 $mm^2/s$.

15. The bearing lubricant composition according to claim 8, wherein the kinematic viscosity at 40° C. is within a range of 7 to 20 $mm^2/s$.

16. The bearing lubricant composition according to claim 9, wherein the kinematic viscosity at 40° C. is within a range of 7 to 20 $mm^2/s$.

* * * * *